US006832634B1

(12) United States Patent
Chantalat

(10) Patent No.: US 6,832,634 B1
(45) Date of Patent: Dec. 21, 2004

(54) METHOD AND APPARATUS FOR CARBONATING BOTTLED LIQUID WITH MINIMUM OXYGEN ENTRAINMENT

(76) Inventor: Vinit Chantalat, 11681 Dawson Dr., Los Altos Hills, CA (US) 94024

( * ) Notice: Subject to any disclaimer, the term of this patent is extended or adjusted under 35 U.S.C. 154(b) by 0 days.

(21) Appl. No.: 10/697,061

(22) Filed: Oct. 29, 2003

(51) Int. Cl.[7] ..... B65B 1/04
(52) U.S. Cl. ..... 141/64; 141/98; 261/DIG. 7
(58) Field of Search ..... 141/59, 63, 64, 141/98, 351; 261/DIG. 7; 22/3, 5, 399

(56) References Cited

U.S. PATENT DOCUMENTS

| | | | | |
|---|---|---|---|---|
| 3,937,350 A | | 2/1976 | Volker | |
| 3,986,535 A | * | 10/1976 | Meckstroth | 141/113 |
| 4,076,142 A | | 2/1978 | Naz | |
| 4,175,668 A | | 11/1979 | Hebert | |
| 4,534,482 A | | 8/1985 | Boucle | |
| 4,842,151 A | | 6/1989 | Scott | |
| 5,056,676 A | | 10/1991 | Allen et al. | |
| 5,117,995 A | | 6/1992 | Kau | |
| 5,396,934 A | * | 3/1995 | Moench | 141/5 |
| 5,566,730 A | * | 10/1996 | Liebmann, Jr. | 141/64 |
| 5,947,310 A | | 9/1999 | Wagner | |
| 5,975,322 A | | 11/1999 | Reid | |
| 6,036,054 A | * | 3/2000 | Grill | 222/3 |

* cited by examiner

*Primary Examiner*—Steven O. Douglas
(74) *Attorney, Agent, or Firm*—Donald R Boys; Central Coast Patent Agency, Inc.

(57) ABSTRACT

A system for carbonating a liquid with carbon dioxide gas comprises a pressurized source of carbon dioxide gas, a user-operable three-way valve system having a first, a second, and a third orifice providing a first, a second and a third valve state, which in the first state connects the first orifice with the second orifice, in the second state connects the second orifice with the third orifice, and in the third state closes internal passage between all orifices, the valve system connected from the first orifice and a conduit to the pressurized source of carbon dioxide gas, and a closure assembly having an interface to a nozzle of a container for liquid and an orifice connected through a conduit to the second orifice of the three way valve system. The system is characterized in that placing the three-way valve system in the first state admits carbon dioxide under pressure to the container, placing the three-way valve system in the second state connects the container for liquid to the third orifice of the three way valve system, allowing the container for liquid to de-pressurize, and placing the three-way valve system in the third state closes all passages between orifices.

9 Claims, 9 Drawing Sheets

METHOD AND APPARATUS FOR CARBONATING BOTTLED LIQUID WITH MINIMUM OXYGEN ENTRAINMENT

FIELD OF THE INVENTION

The present invention relates to carbonated liquid beverages, and more particularly relates to a method and apparatus for adding or maintaining carbonation to bottled beverages, and the dilution and purging of air from within the beverage container.

BACKGROUND OF THE INVENTION

Carbonated beverages are typically packaged, stored and shipped in plastic or glass bottles sealed with a removable cap or top, most commonly a threaded screw-on cap which can be quickly and easily removed and replaced during use. However, upon removal of the cap, the carbonated liquid within the bottle will begin to lose its carbonation or "fizz". As the beverage is consumed and removed from the bottle, a greater amount of air remains in the bottle relative to the amount of liquid in the bottle. As the air space within the bottle increases relative to the amount of carbonated liquid, even with the cap on the bottle, the carbon dioxide in the liquid will dissipate into the air space above the liquid, and the carbonated liquid will subsequently continue to lose its carbonation or "fizz".

Further to be above, any air existing within a container holding liquid to be carbonated may be entrained in the liquid in the process of carbonation. Another problem encountered when air exists in the bottle container is that for certain natural carbonated beverages, such as fruit juices and beer, is that exposure to air can cause these types of beverages to spoil, go stale or otherwise degrade. Further, when air exists in such a bottle containing a carbonated beverage, further re-carbonation of the beverage may be prevented.

Carbonating devices of prior art have attempted to slow the loss of carbonation in the liquid by increasing the pressure in the bottle. However, regardless of the volume of air compressed into the bottle, the carbonation of the liquid is still eventually lost simply because air still remains in the bottle. Prior art devices have also attempted to enable the user to carbonate or re-carbonate beverages utilizing such as a valved coupling apparatus having a conduit there through which can be screwably-attached to the bottle, or cap-type enclosures for injecting carbon dioxide or other such pressurizing gases into a bottle of vine, wherein the gas is injected through the cork stopper cap in the nature of a hypodermic needle.

However, many beverage carbonation systems and apparatus in conventional art still do not adequately address the problem of air existing within the bottle above the carbonated beverage prior to the carbonation process, and most do not address the problem at all. In such prior art carbonation methods that do attempt to address problem of air in container, it is generally required that the liquid to be carbonated or re-carbonated be contained in a plastic squeezable bottle, such as a P.E.T. bottle as it is known in the art, such that the air in the bottle may be removed by manually opening a valve on the apparatus attached to the bottle, and simultaneously manually depressing the sides of the bottle to permit a substantial amount of the air present in the bottle to be ejected through the valved coupling on the bottle into the atmosphere.

U.S. Pat. No. 5,396,934 issued to Moench on Mar. 14, 1995, discloses a method and apparatus for injecting gas into a bottled fluid to carbonate or maintain carbonation in the liquid, wherein a valve coupling having a conduit extending there through, which is adapted to fixedly attach to the nozzle of a bottle containing liquid. Practice of the Moench invention, however, requires the use of plastic liquid container bottles, such as P.E.T. bottles, which have flexible sides, because in order to purge the container of air, the user must manually depress the sides of the bottle, and simultaneously hold a valve button open on the valved coupling, in order to expel the air.

U.S. Pat. No. 3,986,535 issued to Meckstroth on Oct. 19, 1976, discloses a system and apparatus for the production of sparkling wine by applying carbon dioxide to wine that is already bottled, utilizing a high pressure cap-type enclosure permitting the carbon dioxide to be applied through the cap with an applicator in the nature of a hypodermic needle. The problem of removing any excess air from the space above the liquid within the container, however, is not addressed in the invention.

U.S. Pat. No. 6,036,054 issued to Grill on Mar. 14, 2000, discloses an attachment adapted for a carbonated liquid container which pressurizes the beverage within the container with carbon dioxide or other pressurize gaseous fluid. The attachment is adapted to screwably attach to the nozzle of a bottle container, and provides the user with the ability to vary and control the gas pressure of the container by manipulating a button extending from the attachment. The invention, however, also fails to adequately address the issue of air still remaining in the container prior to the carbonating process.

Such systems and apparatus are often complex, awkward and cumbersome, and further do not enable the user to adequately remove the existing air in bottles other than plastic squeezable bottles, such as from glass bottles containing wine or beer, for example.

What is clearly needed is an improved method and apparatus for carbonating or re-carbonating liquid contained in a bottle, which provides a carbonating apparatus which is of simple design and easily and economically manufactured, utilizing commercially available elements for manufacture. Such an improved method and apparatus simplifies the process of removing the air from within the bottle prior to the application of the pressurizing gas, by eliminating the need to manually squeeze the bottle while simultaneously manually holding opened a valve to eject the air from the bottle. Such an improved method and apparatus is described below in enabling detail.

SUMMARY OF THE INVENTION

In a preferred embodiment of the present invention a system for carbonating a liquid with carbon dioxide gas is provided, comprising a pressurized source of carbon dioxide gas, a user-operable three-way valve system having a first, a second, and a third orifice providing a first, a second and a third valve state, which in the first state connects the first orifice with the second orifice, in the second state connects the second orifice with the third orifice, and in the third state closes internal passage between all orifices, the valve system connected from the first orifice and a conduit to the pressurized source of carbon dioxide gas, and a closure assembly having an interface to a nozzle of a container for liquid and an orifice connected through a conduit to the second orifice of the three way valve system. The system is characterized in that placing the three-way valve system in the first state admits carbon dioxide under pressure to the container, placing the three-way valve system in the second state connects the container for liquid to the third orifice of the three way valve system, allowing the container for liquid to depressurize, and placing the three-way valve system in the third state closes all passages between orifices.

In some embodiments the three-way valve system comprises a single valve having an internal rotary element for providing the three states. In some cases the rotary element is electrically-powered, and in some cases it is manually-operable.

In a preferred embodiment there is a pressure regulation apparatus attached to the pressurized source of carbon dioxide gas, and a shut-off valve at the pressure regulation apparatus. Also in a preferred embodiment there is a restricted orifice in the closure assembly, such that gas allowed to escape from the liquid container, escapes at a restricted rate.

In another embodiment the system comprises a pedestal-bourn housing with the valve operable through a wall of the housing, and a nozzle through the housing connected to the third orifice of the three way valve. In still another embodiment the closure assembly comprises a valve stem mounted through a threaded cap for the liquid container and an air-chuck connected to attaching to the valve stem and to the conduit to the second orifice of the three way valve. In some cases the system is integrated with a water-cooler.

In another aspect of the invention a method for carbonating a liquid is provided, comprising the steps of (a) placing the liquid in a container leaving a volume of air over the liquid at one atmosphere pressure; (b) pressurizing the volume of air over the liquid with carbon dioxide gas to at least twice atmospheric pressure; (c) releasing the pressure on the container back to one atmosphere, thereby reducing the mass of air in the volume over the liquid by at least a factor of two; (d) re-pressurizing the volume with carbon dioxide gas; and (e) agitating the container to entrain a portion of the gas in the volume over the liquid to within the liquid.

In another embodiment of the method a further step is provided for releasing the pressure on the container, after the agitation step, back to one atmosphere. In some cases the final pressure release is accomplished through a restricted orifice to be slow enough to prevent frothing of the liquid. Also in some cases multiple pressurization and release steps are accomplished before the agitation step.

In yet another aspect of the invention a closure assembly for assembling to a threaded nozzle of a container for liquid is provided, comprising an interface threaded to engage the threaded nozzle, a seal system for rendering the interface to the nozzle hermetically sealed, and an adapter to a conduit for connecting the container to a source of pressurized gas.

In a preferred embodiment the adapter comprises a commercially available valve stem assembled to an especially adapted cap providing the interface threaded to engage the threaded nozzle. In another embodiment there is a commercially available air chuck for connecting to the valve stem. In some cases the adapter comprises a proprietary combination valve stem and threaded interface, and the seal is a rubber washer between the combination valve stem and the nozzle. In still other cases the adapter comprises a proprietary valve stem molded using rubber or other flexible material, the valve stem having a circular sealing wing positioned for sealing between the nozzle and a cap.

BRIEF DESCRIPTION OF THE DRAWING FIGURES

Figure 3A:
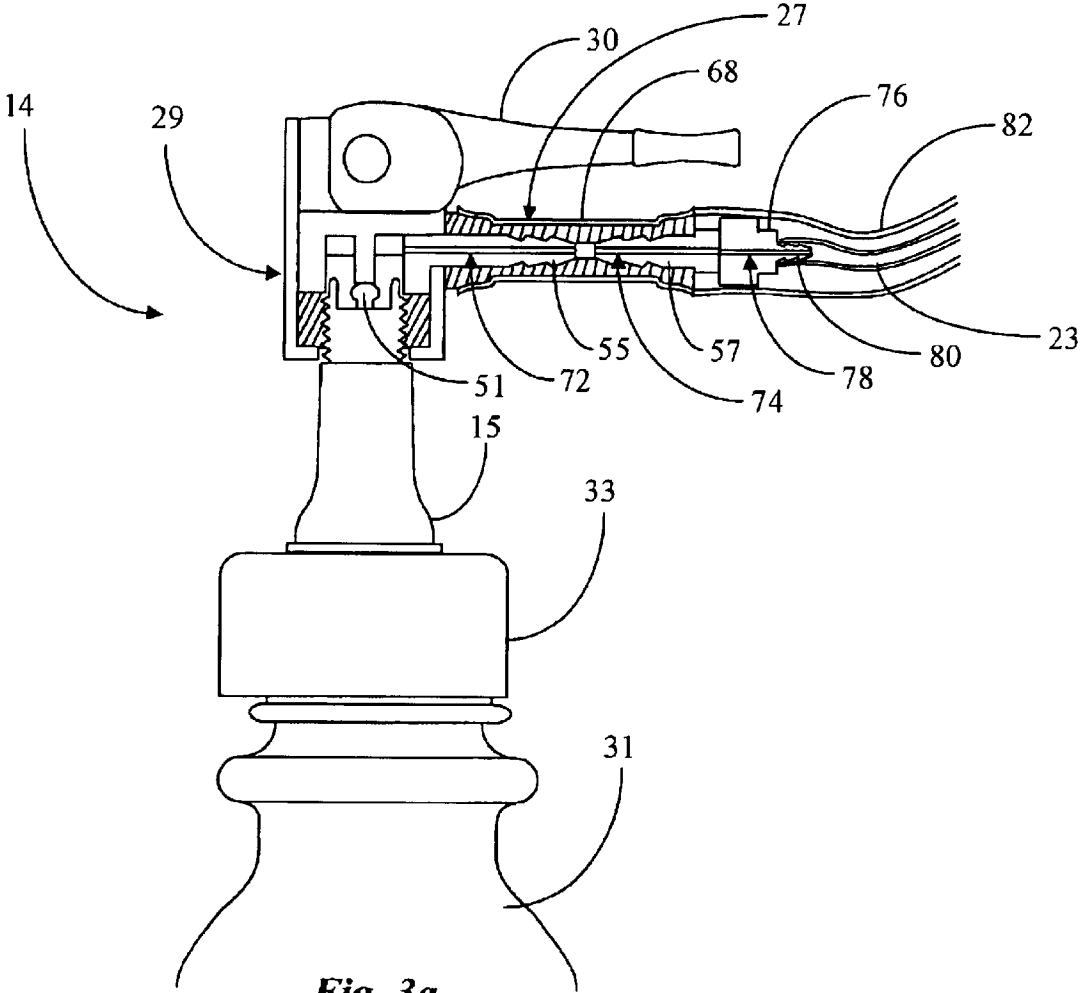
FIG. 3*a* is an elevation view of a portion of FIG. 1 or FIG. 2, showing detail of a bottle closure according to a preferred embodiment of the invention.
Figure 3B:
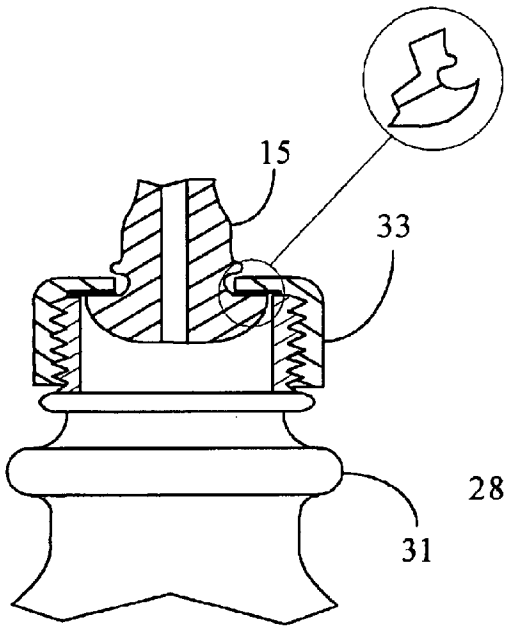

FIG. 3*b* is an elevation and sectioned view of the bottle closure shown in FIG. 3*a*

Figure 3C:
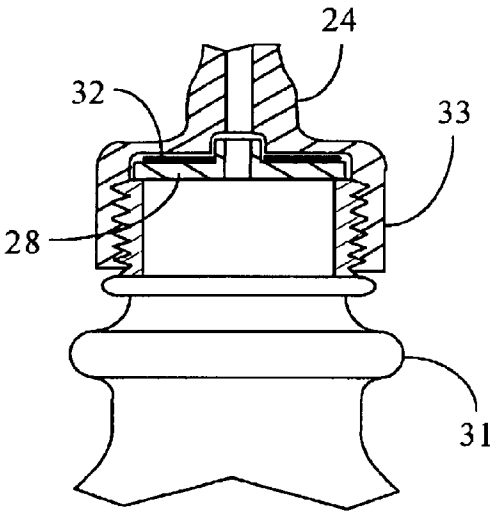

FIG. 3*c* is an elevation and sectioned view of a bottle closure in an alternative embodiment of the invention.

Figure 3D:
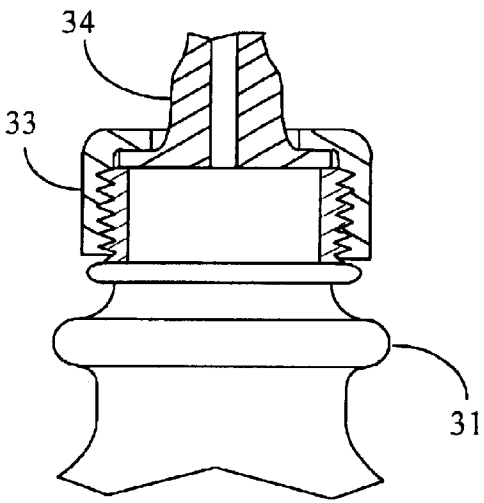

FIG. 3*d* is an elevation and sectioned view of a bottle closure in another alternative embodiment of the invention.

Figure 4B:
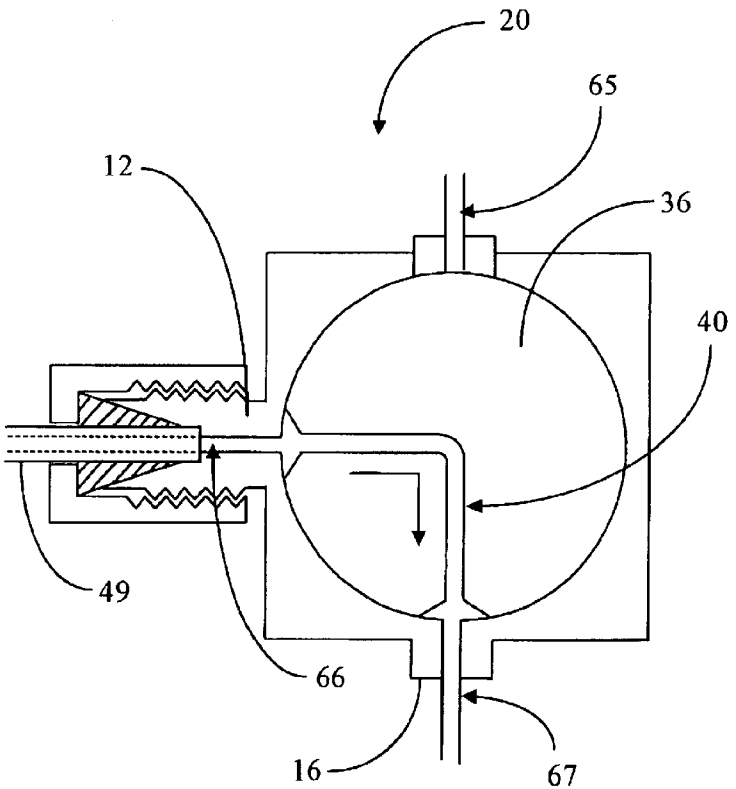
Figure 4A:
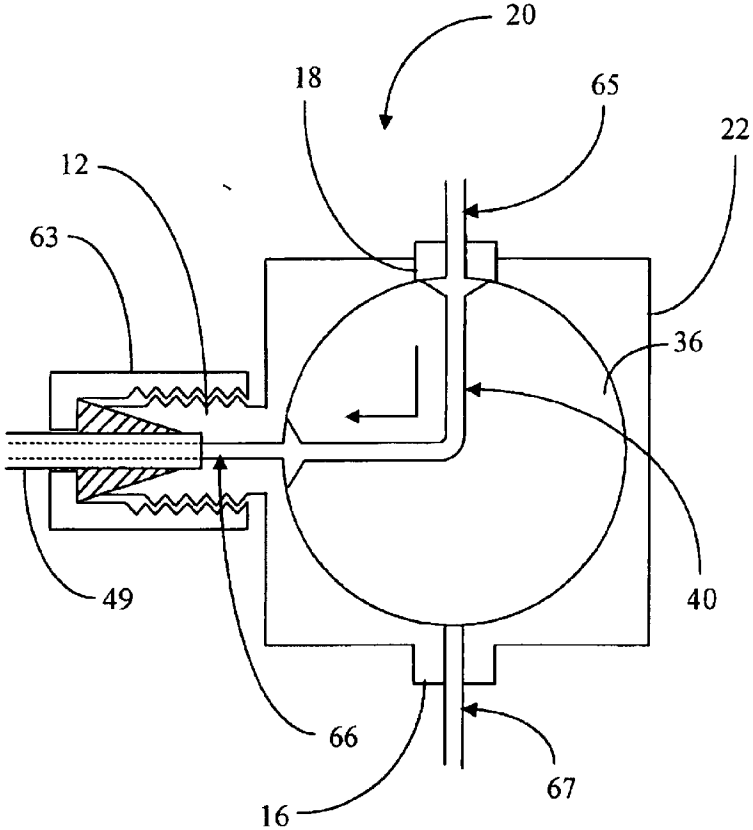

FIG. 4*a* illustrates a three-way valve utilized in the carbonating system of the present invention, set in a pressurize position.

FIG. 4*b* illustrates the three-way valve of FIG. 4*a*, set in a purge position.

Figure 4C:
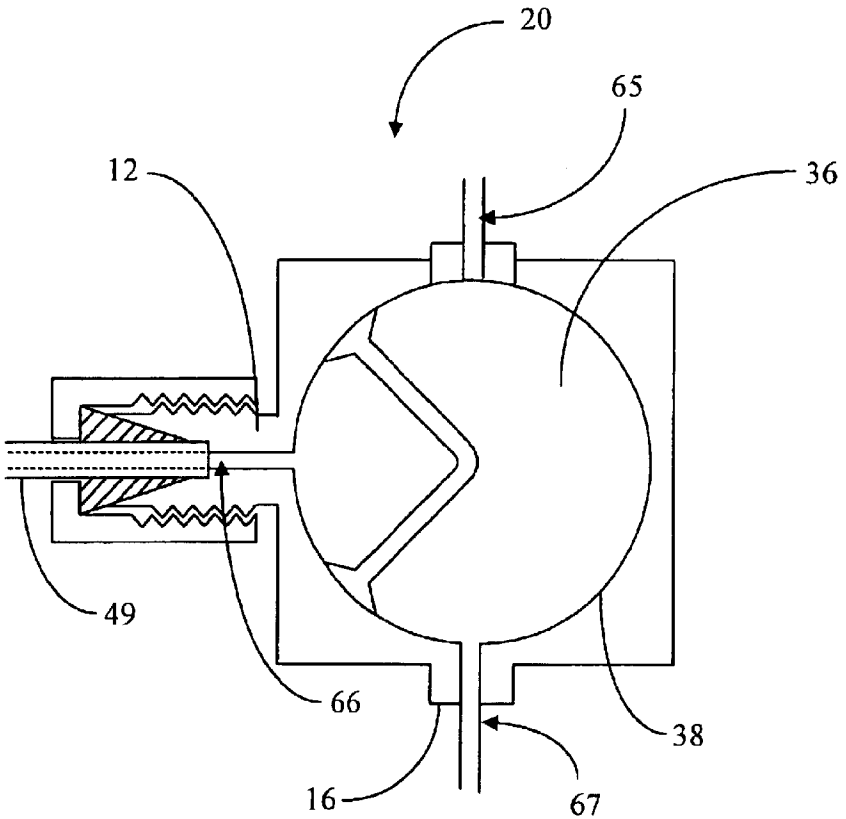

FIG. 4*c* illustrates the three-way valve of FIGS. 4*a* and 4*b*, set in an intermediate position in which all passages are blocked.

Figure 5:
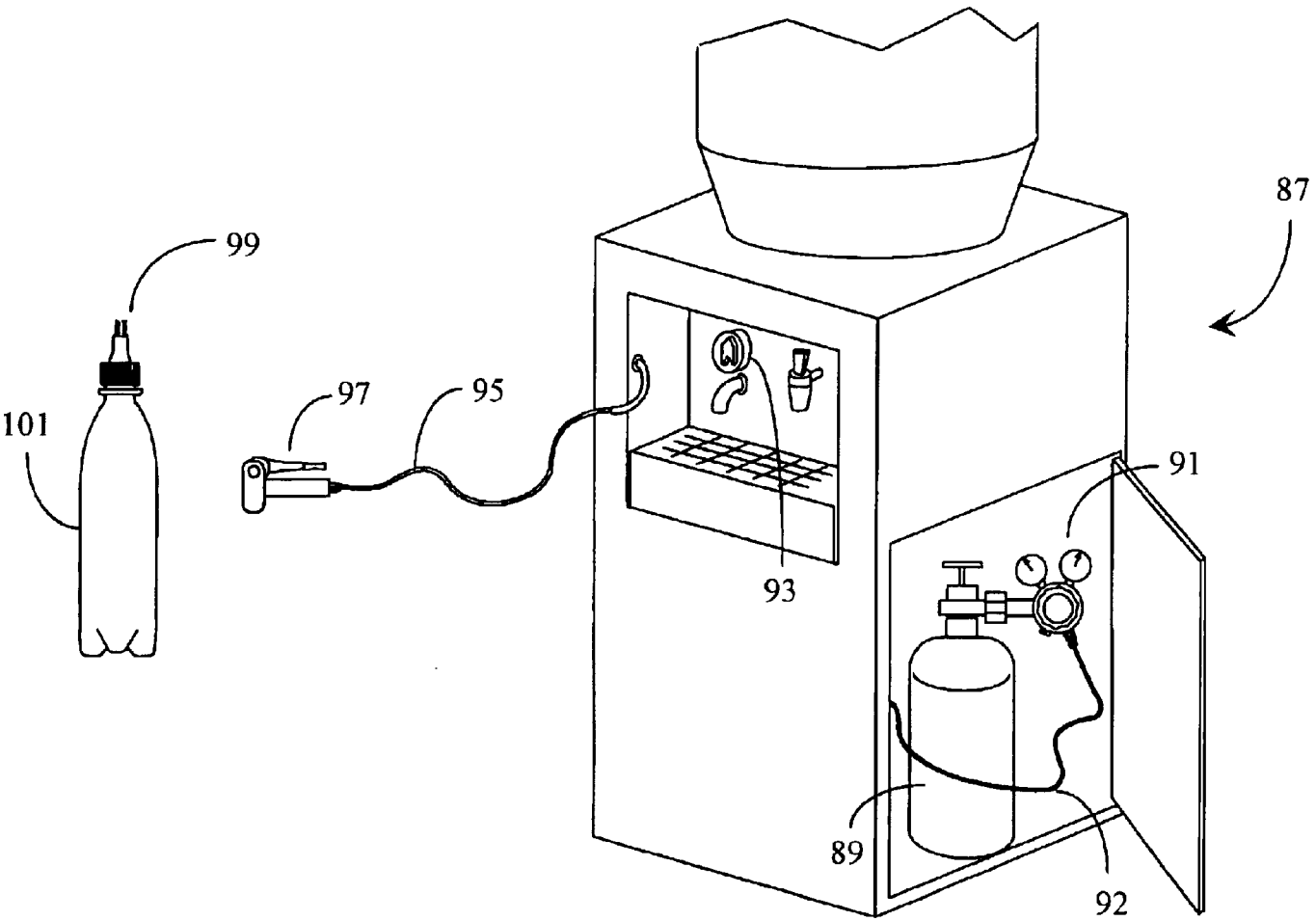

FIG. 5 illustrates a carbonating apparatus according to an embodiment of the present invention, integrated with a water-cooler.

Figure 6:
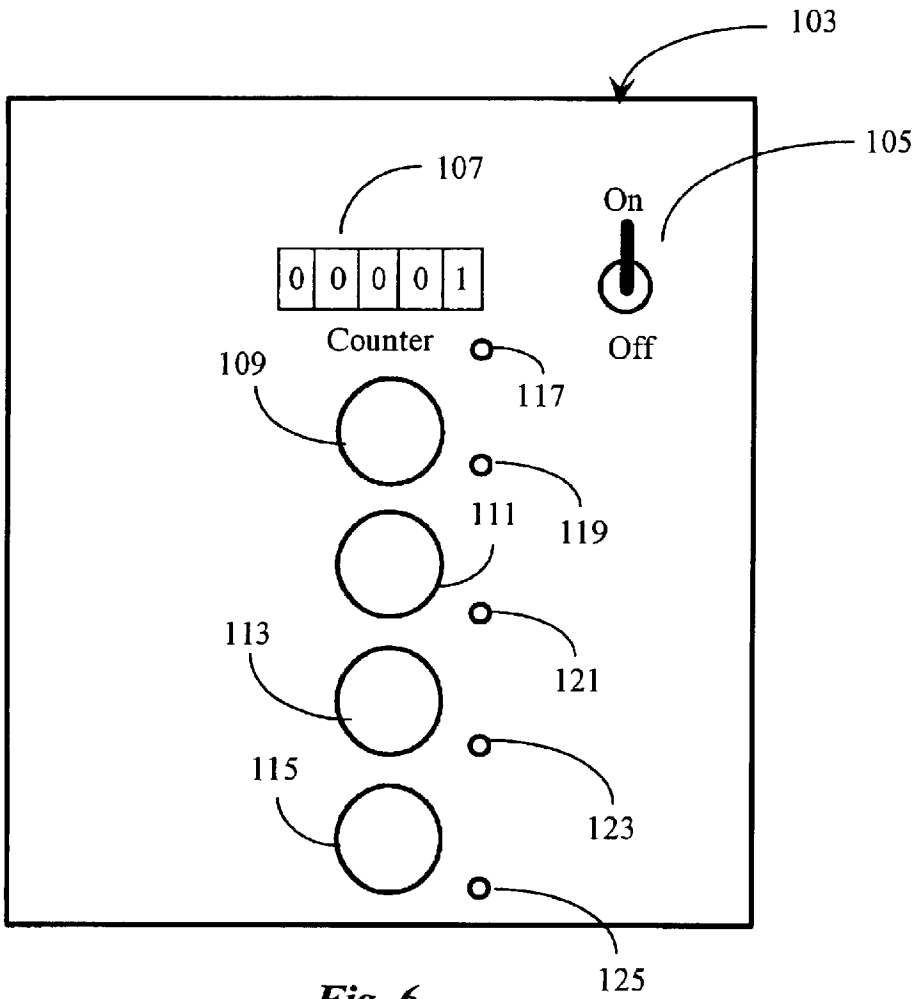

FIG. 6 is an illustration of a control panel in an embodiment of the invention using an electrically-operable three-way valve.

Figure 7:
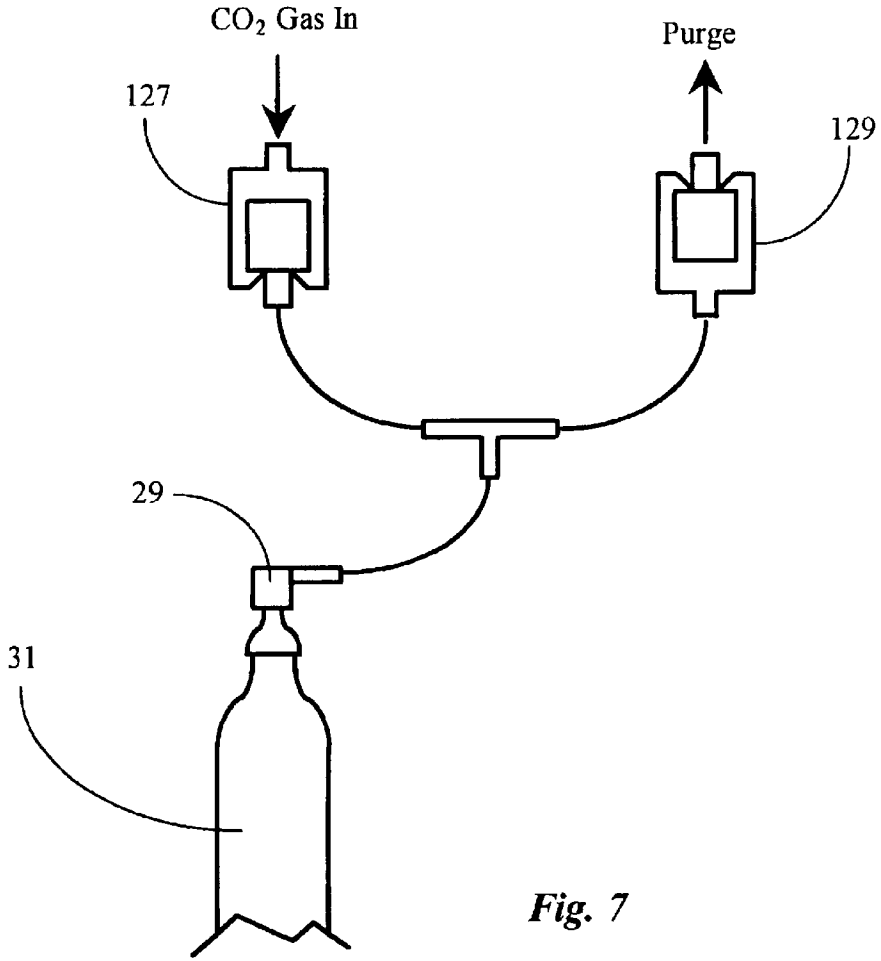

FIG. 7 is a flow diagram illustrating steps in an operation of carbonating a beverage in an embodiment of the invention using the control panel of FIG. 6 and an electrically-operable three-way valve.

DESCRIPTION OF THE PREFERRED EMBODIMENTS

Figure 1:
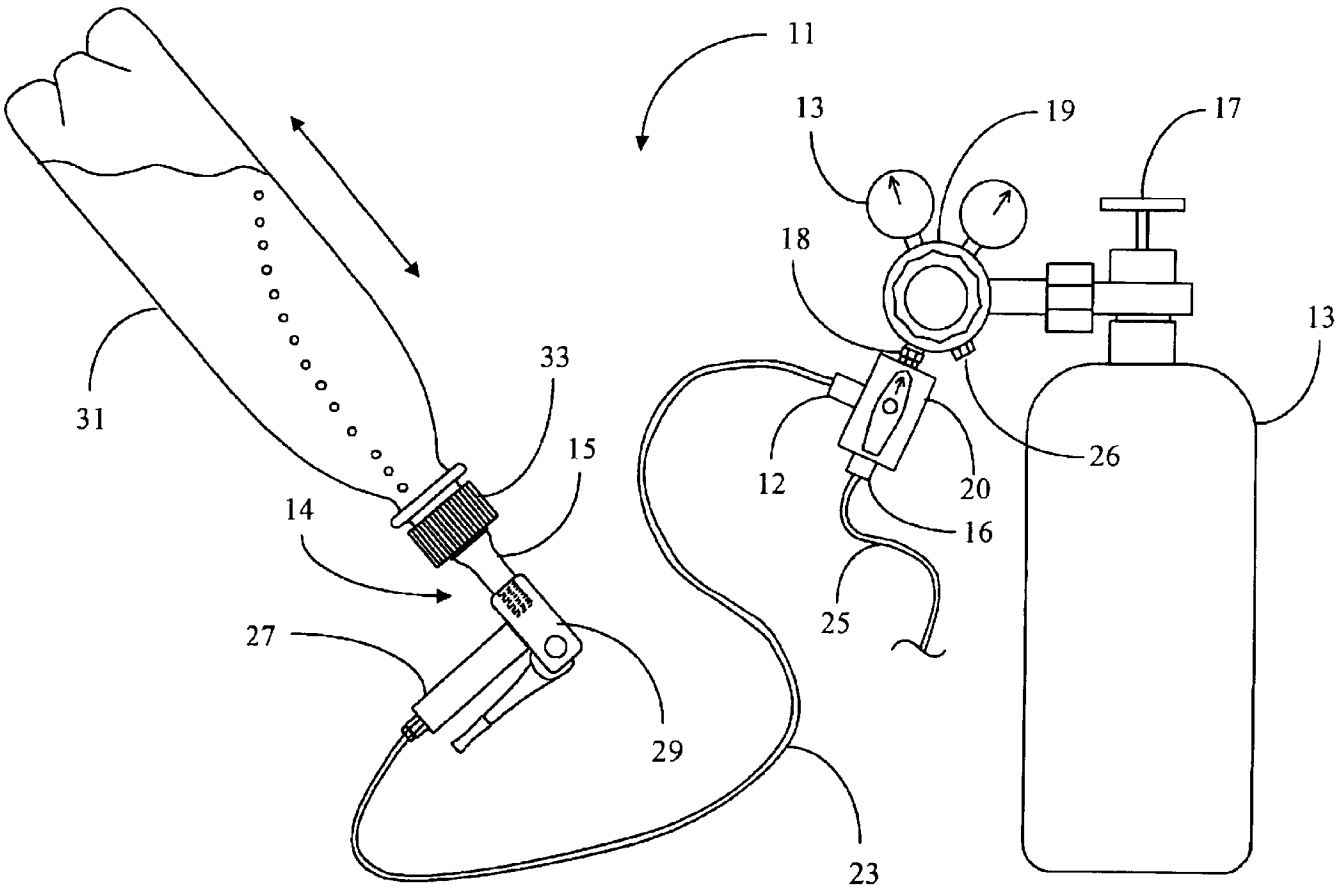
FIG. 1 illustrates an overall system for applying pressurizing gas to bottled liquid according to an embodiment of the present invention.

Referring now to FIG. 1, an improved carbonating system 11 is illustrated in this exemplary view, for applying pressurizing gas, in this case carbon dioxide, to a beverage held by a bottle container 31. It is to be understood that container 31 may hold any beverage or liquid for which carbonation is desired. Carbonator assembly 14 is provided for enabling the carbon dioxide from a supply source to enter container 31, and also for allowing for the release of gases from within container 31 under controlled conditions. Container 31 may be a bottle manufactured of plastic such as polyethylene terephthalate (P.E.T.) or may also be a glass bottle or any other container suitable for holding a beverage or liquid, such as a metal container.

Carbonator assembly 14 comprises a cap 33, valve stem 15, air chuck 29 and adapter 27, all of which are inexpensive and commercially available components. Cap 33 is screwably attachable to the threaded mouth of container 31 and is similar to a common screw-on cap for sealing a standard P.E.T. bottle, such as illustrated, with the exception that cap 33 is adapted for attaching valve stem 15 as detailed further below. Valve stem 15 is the same as those typically used for inflating the tires of bicycles or automobiles, and is adapted to engage to cap 33 providing a conduit for gases to enter or exit container 31, as is also described further below. Air chuck 29 is a standard, inexpensive and commercially available air chuck typically utilized for tire inflating apparatus such as automatic or manual tire pumps, and is provided in this embodiment for clamping and sealing onto the threaded end of valve stem 15, providing the conduit between valve stem 15 and adapter 27. Adapter 27 enables connection between air chuck 29 and flexible tubing 23, and provides a conduit for gases to pass thorough air chuck 29 and into bottle 31. Adapter 27 is adapted to restrict the flow of gases for purposes that are described further below.

Carbonator assembly 14 is coupled to a gas cylinder 13, which contains pressurized carbon dioxide, by flexible tubing 23, through a three-way valve 20. Gas cylinder 13 is a well-known conventional carbon dioxide supply tank, which typically will also comprise a shut-off valve 17, a pressure regulator 19, a safety release valve 26, and one or more of pressure gauges 13.

Three-way valve 20 is coupled to pressure regulator 19, providing a unique aspect of the present invention not found in prior art. Valve 20 has a total of three orifices and a rotary element for selectively channeling pressurized gases out of gas cylinder 13 during the carbonation process, or, by changing the position of the user-operable rotary element of the valve, for channeling gases from container 31 to the outside ambient atmosphere during a purge or dilution process, as described further below, and also in an intermediate position to block all orifices of the valve. In some embodiments of the invention valve 20 (or its equivalent) is a manually-operated valve, with a rotary element that a user may turn. In other embodiments the valve may be electrically-operable, with different positions initiated by a user pressing buttons and the like on a control panel.

Orifice 18 is an inlet orifice provided for attaching valve 20 to regulator 19, and for allowing gases to pass from regulator 19 into valve 20. Orifice 12 serves as an inlet and as an outlet orifice coupled to carbonator 14 by flexible tubing 23, through which pressurized carbon dioxide passes to container 31 during the carbonation process, and through which the gas mixture within container 31 may pass during the purge or dilution process. Orifice 16 is an outlet orifice provided for allowing the purged gases to be expelled into the ambient atmosphere, via flexible tubing 25. It will be apparent to the skilled artisan that a wide variety of three-way valves will be suitable for valve 20 within the spirit and scope of the invention.

As mentioned in the background section, it is desirable for the consumer to easily and inexpensively carbonate a non-carbonated beverage, or re-carbonate a carbonated beverage to restore the beverage's original taste. It is also desirable to substantially dilute or eliminate the air mixture in the space above the carbonated liquid within the bottle before the liquid carbonation step for the reasons mentioned above. The present invention provides a unique capability over systems and apparatus of prior art, provided by the means in which any air existing in the beverage container may be purged from the container before the actual carbonation process takes place, a means which eliminates the need to manually depress a valve on a carbonator apparatus, and simultaneously depress the sides of the container in order to expel air from within the container, as is typical in the prior art The basic steps embodied in the present invention comprise the first step of diluting the oxygen/nitrogen gases from the air space within container 31, releasing or purging the mixture of gases in the air space, and then re-pressurizing container 31 and entraining the pressurized gas, in this case carbon dioxide, into the liquid within container 31.

In actual practice of the present invention with reference to FIG. 1, container 31 is substantially filled in a conventional manner with a beverage or other liquid which is to be carbonated, leaving an air space within container 31 above the liquid to be carbonated, the air space typically comprises a mixture of oxygen and nitrogen gases. Then, beginning a dilution/purge step, container 31 is positioned upright such that the air space within container 31 is above the liquid to be carbonated and directly below the nozzle of container 31.

Cap 33 with valve stem 15 affixed thereto as described above, is then attached to the nozzle by screwably attaching cap 33 to the threaded nozzle portion of container 31, thereby sealing the contents of container 31, as the valve within valve stem 15 remains closed in its resting state by conventional spring action. Air chuck 29 is then secured to the threaded end of valve stem 15 in a conventional manner, thereby clamping and sealing air chuck 29 to valve stem 15, and opening the internal valve of valve stem 15, such that gases may flow into or out of the air space within container 31.

With carbonator device 14, comprising cap 33, valve stem 15, air chuck 29 and adapter 27, securely affixed to the nozzle of container 31, and adapter 27 coupled to the carbon dioxide supply source via flexible tubing 23 and three-way valve 20, carbon dioxide is applied by opening shut-off valve 17 of cylinder 13 and selecting the switch position of three-way valve 20 such that a conduit is opened between cylinder 13 and container 31 allowing carbon dioxide to be forced from the cylinder 13, through three-way valve 20 and flexible tubing 23, through carbonator assembly 14 and finally into the air space within container 31.

As is well-known, the air space above the liquid to be carbonated within container 31 comprises mainly a mixture of oxygen and nitrogen, which are undesirable elements when carbonating certain beverages for consumption, the oxygen being a particular problem. It is an object of the first pressurization step to dilute the gaseous mixture for the purpose of purging the mixture from within container 31. Once all connections are made between container 31 and a carbon dioxide supply source, carbon dioxide is applied to container 31 until the air space above the liquid to be carbonated is pressurized to a factor of about six times atmosphere pressure in a preferred embodiment, or approximately 90 psi., which in turn, dilutes the oxygen/nitrogen ratio within the air space by a factor of six. The rotary element of valve 20 is then turned to an intermediate position which closes all three orifices, as shown in FIG. 4*c* described in further detail below.

Once the air space is pressurized by application of the carbon dioxide, the gaseous mixture containing oxygen/nitrogen along with the applied carbon dioxide is purged from the space above the liquid to be carbonated. This is accomplished by setting the switch position of three-way valve 20, which creates a conduit within three-way valve 20 leading from inlet/outlet orifice 12 to outlet orifice 16, which is connected to flexible tubing 25 leading to the outside atmosphere. Once this setting is accomplished in three-way valve 20, the pressurized gaseous mixture within container 31 may then pass to the outside atmosphere, and the pressure in the bottle returns to one atmosphere.

One unique aspect of the present invention, as described above and illustrated filter below in greater detail, is that adapter 27 of carbonator assembly 14 utilizes a coupling having an internal passage which has a substantially smaller diameter then those used for a conventional air chuck adapter, such that the escaping gaseous mixture flow out of container 31 is restricted so that the gaseous mixture is allowed to escape into the atmosphere at a rate slow enough to prevent frothing of the liquid contents within container 31 during the purge process.

Once the gaseous mixture in the space above the liquid within container 31 has been substantially purged from container 31, the pressurization and dilution/purge process may be repeated to further dilute the small amount of oxygen/nitrogen remaining in the space, again by a factor of six. The process may be repeated as many times as suits the user's purpose, depending on the type of liquid within container 31, and many other factors.

Once the ratio of oxygen/nitrogen to carbon dioxide is low enough to suit the purpose, the next step of re-pressurization of the contents of container 31 may begin, which will carbonate or re-carbonate the liquid contents of container 31. To begin the re-pressurization step, the switch setting of three-way valve 20 is set such that a conduit is open between the carbon dioxide supply source from pressure regulator 19, and carbonator assembly 14, all other passages being closed. Carbon dioxide is then applied to the air space within container 31, which is still in the upright position, by turning the rotary element of valve 20 to the position that connects the gas cylinder 13 with bottle 31. The air space within container 31 is then re-pressurized with the carbon dioxide to the desired factor. At this point, assuming one or more pressure/purge steps have been accomplished, the ratio of air (oxygen/nitrogen) to carbon dioxide in the airspace is very low.

Pressurized container 31 is now inverted and shaken such that the predominately carbon dioxide gaseous mixture in the space above the liquid to be carbonated is entrained into the liquid, thereby carbonating the liquid. As a final step the pressure is released, again slowly, the valve 20 is set to the intermediate closed position, and carbonator assembly 14 may then be disconnected from the nozzle portion of container 31, and a conventional sealing cap may then be screwably attach to the nozzle of container 31, thereby sealing the carbonated liquid contents within. Alternatively, the air chuck 29 may be disconnected from the valve stem of the bottle closure assembly, and the bottle closure assembly left as the seal for bottle 31.

Figure 2:
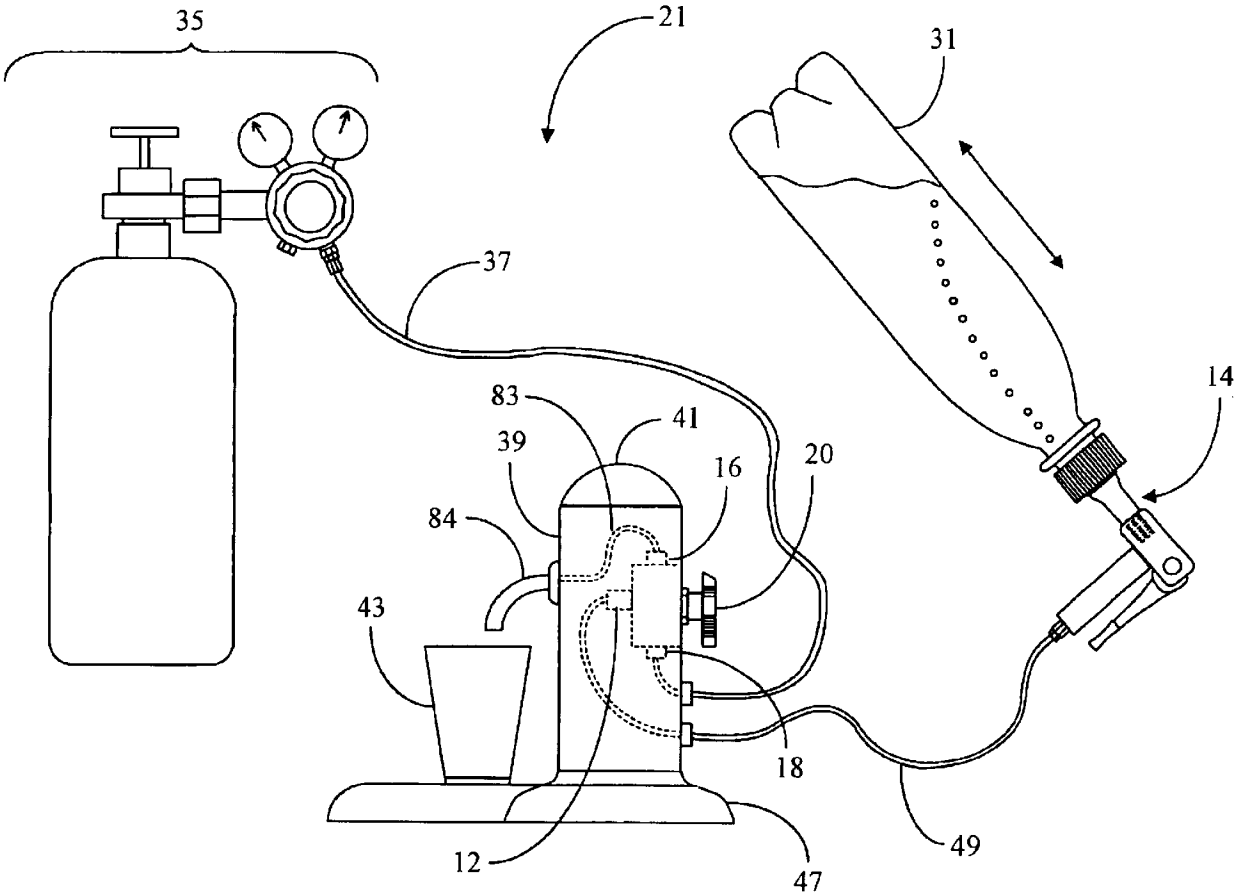
FIG. 2 illustrates an overall process for applying pressurizing gas to bottled liquid according to an alternative embodiment of the present invention

FIG. 2 illustrates an overall process for applying pressurizing gas to bottled liquid according to an alternative embodiment of the present invention. Carbonator system 21 comprises many of the elements of FIG. 1, and such elements accordingly will not be given further elaborate description. In the alternative embodiment illustrated, three-way valve 20 is enclosed in a housing assembly instead of coupling directly to the pressurized carbon dioxide source, as in FIG. 1, adding further convenience and ease-of-use in that the user may operate three-way valve 20 remotely from a carbon dioxide source, and then capture any residual liquid which escapes along with the diluted and purged gaseous mixture from container 31 during the previous dilution/purge process prior to the liquid carbonation step.

In the alternative embodiment illustrated in FIG. 2, carbon dioxide supply source 35 comprises all of the elements illustrated and described relative to FIG. 1, including a gas cylinder whose output is controlled by a shut-off valve, and a standard pressure regulator with pressure gauges. Container 31 holding liquid to be carbonated is sealed with carbonator assembly 14, which is coupled to three-way valve 20 within housing 39 via flexible tubing 49. Flexible tubing 49 extends from carbonator assembly 14 through the wall of housing 39, into the interior of housing 39 and is then connected to the inlet/outlet orifice of valve 20, valve 20 being mounted within housing 39 to the wall of the housing, with the actuator lever on the outside accessible by the user.

Housing 39 in the embodiment illustrated is cylindrical in shape and substantially hollow within, and has a dome-shaped 41, which is removably attached to housing 39 allowing user access to the valve components and tubing within housing 39. Housing 39 is supported by a base 47, which also provides a resting place for a container 43 which has the purpose of capturing any residual liquid that may be expressed along with purged gases from container 31 during the dilution/process mentioned previously. It is noted that the shape and dimensions of housing 39 is not important in practicing the present invention, and may take the form of many different shapes and sizes without departing from the scope and spirit of the present invention.

Within housing 39 a length of flexible tubing 83 is coupled to outlet orifice 16 of three-way valve 20, and leads to an external nozzle 84 for the purpose of directing any residual liquid expressed during the purge process into container 43.

Gas pressure source 35 is coupled to inlet orifice 18 of three-way valve 20 via flexible tubing 37, which couples directly to the regulator of gas pressure source 35, and leads to and extends through the wall of housing 39, and then connects directly to inlet orifice 18 of valve 20.

In practicing this alternative embodiment of the present invention as illustrated in FIG. 2, the method steps for dilution/purging of the oxygen/nitrogen within the air space of container 31 and re-pressurization for carbonating the liquid within, are the same as those for system 11 of FIG. 1, with the exception that three-way valve 20 is operated from housing 39 as opposed to being coupled directly to the pressurized gas supply source, as in FIG. 1, and the flexible tubing configurations are adapted to accommodate such an arrangement FIG. 3*a* illustrates in detail bottle carbonator closure assembly 14 of FIG. 1, affixed to the nozzle of container 31 according to an embodiment of the present invention. In this illustration an enlarged, cross-section view is given to better illustrate internal key elements of carbonator assembly 14 which provides the present invention the unique capabilities described above over carbonator apparatus of prior art.

As mentioned with reference to FIG. 1, cap 33 is a conventional threaded bottle cap modified for attaching carbonator closure assembly 14, and valve stem 15 is a common, commercially available valve stem typically used for inflating the tires of bicycles or automobiles. Specifically, a round through-opening is formed through the upper portion of cap 33, its circumference slightly less than the outside diameter of the mounting collar of valve stem 15, such that a tight and secure fit is achieved when valve stem 15 is attached to cap 33 as illustrated. Commercially-available valve stems are notoriously well-known in the art. Some further detail of the valve stem interface to the bottle and cap is shown in FIG. 3*b* described below.

As described previously valve stem 15 is a conventional and commercially available valve stem, having a passage open to the interior of container 31 and extending up through the body of valve stem 15 extending to an internal valve portion (not shown) within valve stem 15, the valve portion, as is conventional, held in a resting closed state by spring action. Valve stem also conventionally includes a valve actuated by pin 51 which is urged upwards in its resting state by spring action, thereby closing the internal valve mechanism, and may be depressed down into valve stern 15 in order to open the internal valve mechanism.

Air chuck 29 is shown in the illustration attached to the upper threaded portion of valve stem 15 in a conventional manner, and actuating lever 30 is in the clamping horizontal position, which seals the opening of air chuck 29 around the upper threaded portion of valve 15, while simultaneously actuating a protrusion which depresses valve pin 51 which opens the internal valve mechanism of valve stem 15.

A conduit is thereby opened between the space within container 31 and adapter 27. As mentioned earlier, adapter 27 is similar to those used conventionally in air chucks known in the art, with the exception that a special nozzle 57 attachable to adapter 27, is utilized in order to significantly reduce the flow rate of gases escaping from container 31 during a purge process, as detailed above. Specifically, adapter 27 comprises a nozzle 55 and a nozzle 57 which are similar to those of known adapters of conventional art, nozzle 55 having a passage 72 extending their through, and nozzle 57 having a similar passage 74.

A unique aspect of adapter 27, however, is the application of a special nozzle adapter 76 which has a passage 78 extending therethrough providing a restricted orifice, which has an inside diameter significantly less than that of passages of nozzles of conventional air chuck adapters, such as passages 72 and 74. The inside diameter of passage 78 is significantly less in area than passages 72 and 74, in order to substantially slow the release of gases escaping from container 31 during the purge process, for the purpose of preventing frothing of carbonated liquid within container 31, which would otherwise occur during a purge step utilizing a large opening as is conventionally used in a common, commercially available air chuck.

It has been determined through empirical testing that the inside diameter of passage 78 is ideally between 1/16 inch and 3/64 inch. However, said dimension may vary in alternative embodiments, providing that the flow of escaping gases from within container 31 is substantially curtailed when the internal valve mechanism of valve stem 15 is open during the purge process, in order that frothing of the liquid wit the container during purge is substantially reduced or eliminated.

Adapter 27 further comprises in this embodiment a rubberized enclosure surrounding and securing together nozzles 55 and 57, the rubberized enclosure encased by a tubular collar 68. It is herein noted that adapter 27 is a conventional, commercially available adapter typically used with common air chucks such as air chuck 29. The special nozzle adapter 76, having passage 78 with a significantly reduced diameter to provide a restricted orifice is adapted to couple to nozzle 57, and has a small nozzle 80, which has an opening having a diameter equal to that of passage 78. One end of flexible tubing 23 has an inside diameter slightly less than the outside diameter of nozzle 80 such that the end of tubing 23 may be fitted securely over nozzle 80, tubing 23 leading to, and coupled to three-way valve 20 and ultimately to the carbon dioxide supply source. A rubberized protective sheath 82 is utilized to protect the connection between flexible tubing 23 and special nozzle fitting 76, one end of sheath 82 slipping securely over the end of nozzle fitting 76, and extending partially along the length of, and enclosing flexible tubing 23.

The detail shown in FIG. 3*b* is for a closure using a commercially available valve stem, as described above. There are a number of alternative ways the closure may be accomplished, however, within the spirit and scope of the invention. FIG. 3*c*, for example is an elevation and sectioned view of a bottle closure in an alternative embodiment of the invention. In the alternative embodiment of FIG. 3*c* a proprietary plastic valve stem 24 is provided comprising all of the elements of a conventional valve stem, plus a cap portion for interfacing to the threaded nozzle of a bottle. A washer 28 of rubber or other flexible material serves as a sealing element between bottle 31 and stem 24, and a sliding washer 32 facilitates assembly and disassembly.

FIG. 3*d* is an elevation and sectioned view of a bottle closure in yet another alternative embodiment of the invention. In FIG. 3*d* a proprietary valve stem 34 comprising rubber or other flexible material and having a circular sealing wing fitting between bottle 31 and cap 33 is provided, having all of the necessary valve stem elements. There are thus three different embodiments shown as examples of valve stems and interfacing valve stems to a bottle. These three are parts of a larger set of possible designs that might be used.

FIG. 4*a* illustrates a three-way valve utilized in the carbonating system of the present invention, set in the pressurize position. In this exemplary view, three-way valve 20 of FIGS. 1 and 2 is illustrated, having an enclosure 22, an internal rotary element 36 having passages therein, inlet orifice 18, inlet/outlet orifice 12, and outlet orifice 16. Orifice 16 accommodates passage 65, which leads to the carbon dioxide supply source. Although detail is not shown in this exemplary view, it may be assumed that orifices 16 and 18 have threaded outer portions and utilize a standard threaded coupling such as coupling 63 which secures flexible tubing 49 to orifice 12. As described briefly above, the valve may be either a manually-operable valve or an electrically-operable valve.

In the simplified illustration element 36 is in the charge, or pressurize position, wherein pressurized carbon dioxide from the supply source enters passage 65 through inlet orifice 18, into passage 40 of element 36, and then out through inlet/outlet orifice 12 via passage 66 and into flexible tubing 49 wherein the pressurized carbon dioxide passes to air chuck 29 connected to the nozzle of bottle container 31, as in FIG. 1. The position of element 36 within three-way valve 20 is the position used in the first pressurization step in preparation for the dilution/purge step as outlined above, as well as the final pressurization step following the dilution/purge step.

FIG. 4*b* illustrates three-way valve 20 of FIG. 4*a*, set in the purge position. The setting of element 36 within valve 20 in this illustration is utilized during the dilution/purge process, wherein pressurized gases within the air space above the liquid held by bottle container 31 are allowed to escape container 31 and eventually pass to the outside atmosphere. In this setting, the escaping gases pass from container 31 through carbonator device 14 as described above, through flexible tubing 49, and then enters internal passage 40 via inlet/outlet orifice 12, and then out of valve 20 via outlet orifice 16, into outlet passage 67 and eventually into the outside atmosphere.

FIG. 4*c* illustrates valve 20 of FIGS. 4*a* and 4*b* with rotary element 36 set in an intermediate position wherein all orifices are closed, that is, no internal passage connects any two orifices.

As described above, the three-way valve may be in some embodiments an electrically-operable valve. FIG. 6 is an illustration of a control panel usable with an embodiment incorporating an electrically-operable three way valve. In one alternative the electrically-operable three-way valve is structurally similar to the rotary valve described and shown in FIGS. 4*a*, 4*b* and 4*c*, and the internal rotary element (36) is rotated by an electrical rotary actuator. In this case assume as a starting point that the internal rotary element is in the position shown in FIG. 4*c*, blocking all internal passages.

Referring to FIG. 6, control panel 103 has an on-off switch 105. When the power switch is on and power is applied, green LED 117 will be lit. A timer-counter 107 is provided to allow an operator to time application of gas to a beverage. Assuming a beverage has been added to container 31 and the air chuck is in place, the user presses button

109. This opens the three-way valve to the position of FIG. 4*a*, applying pressurized gas to bottle 31, and also lights green LED 119. This also starts the timer-counter. The user now shakes the bottle lightly and upright for a prearranged time, which may be timed watching the timer-counter. This is the dilution step.

After the pre-arranged time, the user presses button 111, which moves the rotary valve to the position shown in FIG. 4*b*, allowing the gas in container 31 to purge to atmosphere. Yellow LED 121 lights indicating the purge state (green LED 119 goes out).

Now the user presses button 113. Green LED 123 lights and yellow LED 121 goes out. The rotary valve returns to the pressurize position shown in FIG. 4*a* and the timer resets. The user now moves the bottle to an upside-down position and shakes the bottle vigorously several times, which may be counted or timed using the counter as well. This is the carbonation step.

Now the user presses button 4. The rotary valve moves first to the purge position (FIG. 4*b*) to allow the pressure in the container to purge, then to the closed position shown in FIG. 4*c*, which was the starting position. The user can now remove the air chuck and cap the bottle or use the contents. The system is back in its start position.

In an alternative embodiment the three-way valve action is provided by two solenoid-operated valves 127 and 129 connected by a tee 131 to the container 31 through the air chuck 29 (FIG. 1) as shown in FIG. 7, rather than by a rotary element as described above. In this case the operation of the buttons closes both valves 127 and 129 to provide the function of position 4*c* of the rotary valve, and opens valve 127 or 129 selectively to provide the functions of the rotary valve in positions shown by FIGS. 4*a* and 4*b*. The result is the same as described above for the rotary valve.

In a further alternative embodiment of the present invention, as shown in FIG. 5, a carbonation system according to the invention is integrated with a water cooler. In this embodiment carbon dioxide pressure cylinder 89 with shut off valve and pressure regulator assembly 91 is housed within the lower cabinet of the water cooler. The pressure cylinder is connected by the conduit 92 to a three-way valve 93 mounted behind a wall of the cooler. The three way valve may be mounted in any of several places, as long as it is readily accessible to a user.

From the three way valve a conduit 95 extends to adapter 97 which attaches to a detaches from valve stem 99 in a cap for bottle 101. Operation in this case is the same as described above for other embodiments, including purging and dilution by one or more pressurization and purge cycles to reduce the amount of air in the space over the liquid in bottle 101, after which the bottle is pressurized with carbon dioxide again, and the bottle is shaken to entrain the carbon dioxide in the liquid. Then the pressure is released slowly as above-described Integration with the water cooler allows for carbonating the water drawn from the water cooler to improve the sensation and taste.

Although a certain and specific apparatus and method is illustrated and described herein, it is to be understood that a variety of modifications may be had without departing from the spirit and scope of the invention. Accordingly, many different applications other than carbonating beverages for consumption, for example, may benefit from the present invention without departing from the overall spirit and scope of the invention. For these reasons, the present invention should be afforded the broadest possible scope under examination. The spirit and scope of the invention is limited only by the claims that follow.

What is claimed is:

1. A system for carbonating a liquid with carbon dioxide gas, comprising:

a pressurized source of carbon dioxide gas;

a user-operable three-way valve system having a first, a second, and a third orifice providing a first, a second and a third valve state, which in the first state connects the first orifice with the second orifice, in the second state connects the second orifice with the third orifice, and in the third state closes internal passage between all orifices, the valve system connected from the first orifice and a conduit to the pressurized source of carbon dioxide gas; and a closure assembly having an interface to a nozzle of a container for liquid and an orifice connected through a conduit to the second orifice of the three way valve system;

characterized in that placing the three-way valve system in the first state admits carbon dioxide under pressure to the container, placing the three-way valve system in the second state connects the container for liquid to the third orifice of the three way valve system, allowing the container for liquid to de-pressurize, and placing the three-way valve system in the third state closes all passages between orifices.

2. The system of claim 1 wherein the three-way valve system comprises a single valve having an internal rotary element for providing the three states.

3. The system of claim 2 wherein the internal rotary element is electrically powered, and the system further comprises a control panel with user inputs for initiating the states.

4. The system of claim 2 wherein the internal rotary element is manually-operable.

5. The system of claim 1 further comprising a pressure regulation apparatus attached to the pressurized source of carbon dioxide gas, and a shut-off valve at the pressure regulation apparatus.

6. The system of claim 1 further comprising a restricted orifice in the closure assembly, such that gas allowed to escape from the liquid container, escapes at a restricted rate.

7. The system of claim 1 further comprising a pedestal-bourne housing with the valve operable through a wall of the housing, and a nozzle through the housing connected to the third orifice of the three way valve.

8. The system of claim 1 wherein the closure assembly comprises a valve stem mounted through a threaded cap for the liquid container and an air-chuck connected to attaching to the valve stem and to the conduit to the second orifice of the three way valve.

9. The system of claim 1 integrated with a water-cooler.

* * * * *